US011970833B2

(12) United States Patent
Zitterbart et al.

(10) Patent No.: US 11,970,833 B2
(45) Date of Patent: Apr. 30, 2024

(54) QUICK COUPLING HAVING A CENTERING DEVICE

(71) Applicant: Liebherr-Hydraulikbagger GmbH, Kirchdorf/Iller (DE)

(72) Inventors: Thomas Zitterbart, Dietenheim (DE); Robert Grau, Senden (DE)

(73) Assignee: LIEBHERR-HYDRAULIKBAGGER GMBH, Kirchdorf/Iller (DE)

( * ) Notice: Subject to any disclaimer, the term of this patent is extended or adjusted under 35 U.S.C. 154(b) by 531 days.

(21) Appl. No.: 17/233,363

(22) Filed: Apr. 16, 2021

(65) Prior Publication Data

US 2021/0324600 A1 Oct. 21, 2021

(30) Foreign Application Priority Data

Apr. 17, 2020 (DE) ..... 10 2020 110 523.1

(51) Int. Cl.
*E02F 3/36* (2006.01)

(52) U.S. Cl.
CPC ..... *E02F 3/3654* (2013.01); *E02F 3/3663* (2013.01)

(58) Field of Classification Search
CPC ..... E02F 3/3654; E02F 3/3609; E02F 3/3613; E02F 3/3645
USPC ..... 33/644, 655
See application file for complete search history.

(56) References Cited

U.S. PATENT DOCUMENTS 4,116,346 A * 9/1978 Uchida ..... E02F 3/3663 414/723
5,333,695 A 8/1994 Walter
2009/0051163 A1 2/2009 Frey et al.
2009/0235561 A1* 9/2009 Muller ..... E02F 3/3654 37/468
2009/0255151 A1* 10/2009 Wimmer ..... E02F 3/3654 37/468
2016/0113188 A1* 4/2016 Huegerich ..... E02F 3/3654 180/53.1
2016/0326712 A1* 11/2016 Koestler ..... E02F 3/3631

FOREIGN PATENT DOCUMENTS

EP 1239087 A1 * 9/2002 ..... E02F 3/3654
EP 1239087 A1 9/2002
EP 2018456 B1 8/2012
WO 2019081831 A1 5/2019

* cited by examiner

*Primary Examiner* — Jamie L McGowan
*Assistant Examiner* — Audrey L Lusk
(74) *Attorney, Agent, or Firm* — McCoy Russell LLP

(57) ABSTRACT

The invention relates to a quick coupling for coupling a tool to the boom of a working machines, comprising a quick coupling part at the boom side and a quick coupling part at the tool side that are latchable to one another via two spaced apart latching axles and an energy circuit coupling for the automatic coupling of an energy connector at the tool side and an energy connector at the boom side that comprises an energy coupling part at the boom side and an energy coupling part at the tool side that move toward one another by pivoting together about a first latching axle on an orbit and thereby automatically couple with one another. At least one of the energy coupling parts is movably supported. The energy circuit coupling comprises a linear guide that compensates the circular relative movement of the energy coupling parts on the pivoting together and guides them linearly toward one another.

15 Claims, 4 Drawing Sheets

Section B-B

QUICK COUPLING HAVING A CENTERING DEVICE

CROSS REFERENCE TO RELATED APPLICATION

The present application claims priority to German Patent Application No. 10 2020 110 523.1 filed on Apr. 17, 2020. The entire contents of the above-listed application is hereby incorporated by reference for all purposes.

TECHNICAL FIELD

The present invention relates to a quick coupling for coupling a tool to the boom of a working machine in accordance with the preamble of claim 1 and to a working machine having such a quick coupling.

BACKGROUND AND SUMMARY

Quick couplings of the pivoting type are widespread in certain working machines such as hydraulic excavators since they permit a simple and fast changing of different tools such as hydraulic grabs, ditch buckets, reachers, and the like. Initially, only one of two latching axles of the quick coupling have to be positioned and brought into engagement for the coupling. This can advantageously be a cross pin that is hung into a hook-like eyelet at the oppositely disposed quick coupling part. The quick coupling part at the boom side can then be pivoted relative to the tool about the latching axle already brought into engagement to hereby locate the latching position in which the second latching angle can be latched. The latter is as a rule formed by a pair of latching pins that can travel apart and into corresponding latching bores at the oppositely disposed quick coupling part.

To establish a hydraulic connection, such quick couplings can have an energy circuit coupling or a hydraulic coupling, with each of the quick coupling parts having a corresponding energy coupling part that can pivot together with the quick coupling parts and can automatically be brought together. To compensate the circular movement of the energy coupling parts relative to one another on the pivoting of the quick coupling parts about the first latching axle, it is known to movably support one of the two energy coupling parts, typically the energy coupling part at the tool side, on an arrangement of compression springs, for example. However, a non-optimum coupling frequently occurs in this process that can result in an oil leak.

To eliminate this shortcoming of known energy circuit couplings and to prevent a canting of the connection connectors of the energy coupling parts, it has been suggested in EP 1 239 087 A1 to provide a linear guide for the energy coupling parts that forces them to make a linear relative movement toward one another along a straight line against the orbital pivot movement. For this purpose, the linear guide has guide elements that cooperate at the energy coupling parts at the boom side and at the tool side during coupling and that can, for example be configured as guide pins and guide bores that engage into one another before the bringing together of the connection connectors and effect an exactly linear relative movement.

However, this coupling concept only works without error when the movably supported energy coupling part does not deviate from a defined center position or central position in which the guide elements of the linear guide are aligned can be guided into one another without canting. The use of the quick coupling in applications in which the freely movably supported energy coupling part is deflected from the central position due to its own weight is thereby made more difficult or even prevented. This problem increases when tubes are connected to the energy coupling part whose own tension even amplifies the deflection of the energy coupling part from the central position.

An example for such a problematic installation position is the use of such a quick coupling in a wheel loader. Unlike with a hydraulic excavator, the installation orientation of the energy coupling part at the tool side is perpendicular, i.e. the straight coupling of the energy coupling parts communicated by the linear guide takes place along a substantially horizontal line. Due to the weight of the movable energy coupling part, it pivots out of the central position due to gravity so that the guide elements or guide pins and guide bores are no longer aligned with one another. The coupling or coupling in of the guide elements is made more difficult or even impossible by the deflection of the movable energy coupling part. Increased wear or damage can therefore occur if the coupling is performed with force to overcome the offset.

It is therefore the underlying object of the present invention to overcome this disadvantage and to enable the use of such a quick coupling independently of the installation position and situation of the energy coupling parts.

This object is achieved in accordance with the invention by a quick coupling having the features of claim 1. The quick coupling in accordance with the invention that is provided for coupling a tool to the boom of a working machine, in particular a wheel loader, accordingly comprises a quick coupling part at the boom side and at the tool side and an energy circuit coupling for the automatic coupling of an energy connector at the tool side to an energy connector at the boom side. The quick coupling parts are reversibly latchable to one another via a pair of spaced apart latching axles.

The energy circuit coupling comprises an energy coupling part at the boom side and at the tool side that are arranged at the two quick coupling parts such that they move toward one another and thereby automatically couple with one another by the pivoting together of the two quick coupling parts about a first one of the two latching axles on an orbit about the first latching axle. At least one of the two energy coupling parts, in the following also called a movable energy coupling part, is movably or displaceably supported about an axis in parallel with or perpendicular to the first latching axle.

The energy circuit coupling further comprises a linear guide that is configured to compensate the relative movement of the two energy coupling parts occurring along an orbit on the pivoting together of the quick coupling parts in cooperation with the movable support of the movable energy coupling part and to guide the two energy coupling parts linearly, i.e. along a straight line, with respect to one another during coupling.

In accordance with the invention, the quick coupling additionally comprises a centering device by means of which the movable energy coupling part is holdable in a central position independently of its spatial alignment or orientation and a movement of the movable energy coupling part relative to the quick coupling part fastened thereto is preventable in the absence of an external force. The centering device is configured in accordance with the invention to enable a movement of the movable energy coupling part relative to the quick coupling part fastened thereto on the automatic coupling with the other energy coupling part due to an external force generated by the coupling procedure.

That force is called an external force in the present case that does not result from the weight of the movable energy coupling part or permanently engages thereat due to the storing/fastening/connecting to cables, tubes, etc. of the movable energy coupling part. An external force in the sense of the present invention is in particular a force that is generated by the coupling to the other energy coupling part on the joining together of the two quick coupling parts and that acts on the movable energy coupling part.

The centering device in accordance with the invention provides that the movable energy coupling part does not move out of the central position provided for a frictionless coupling due to the weight, the connection of tubes, or the like, and indeed independently of the installation position or spatial orientation of the movable energy coupling part. It is thereby possible, for example, to install the movable energy coupling part perpendicular at the quick coupling part of a wheel loader blade without it pivoting away downward due to gravity and without a coupling of the energy coupling parts being made more difficult or prevented.

At the same time, the movability of the movable energy coupling part should naturally be maintained within certain limits during the coupling procedure described more exactly in EP 1 239 087 A1 to continue to enable a compensation of the circular movement by means of the linear guide. This movability should, however, only be present when a coupling procedure with the other energy coupling part takes place. The present invention provides for this reason that the centering device is configured only to enable a movement of the movable energy coupling part—within certain limits—when an external force in the above-defined sense acts on it, that is in particular a force generated by the coupling procedure on a contacting of the movable energy coupling part by the other energy coupling part.

The quick coupling in accordance with the invention can thereby be used in any installation position and independently of the connection to other components such as tubes, which substantially expands the possibilities of use. The present invention, however, does not only open up further possibilities for use with installation positions different from the previous situation on hydraulic excavators. The quick coupling in accordance with the invention having a centering device can also advantageously be used with hydraulic excavators in installation positions that are not problematic with respect to weight, namely in particular in those cases in which a tube laying is used that results in a tilting of the movable energy coupling part due to the stresses or preloads of the tubes.

Advantageous embodiments of the invention result from the dependent claims and from the following description.

The quick coupling in accordance with the invention is preferably a quick coupling in accordance with EP 1 239 087 A1 that additionally has the centering device in accordance with the invention. The disclosure of EP 1 239 087 A1 is explicitly included in the present teaching. The quick coupling in accordance with the invention can in particular be configured in accordance with any of the advantageous embodiments described in EP 1 239 087 A1 or in accordance with any combination of the embodiments disclosed therein. The embodiments described in EP 1 239 087 A1 are thus likewise possible embodiments of the present quick coupling in accordance with the invention.

The quick coupling in accordance with the invention can thus, for example be a quick coupling for coupling a tool to the boom of a hydraulic excavator and the like, having a quick coupling part at the boom side and a quick coupling part at the tool side that are latchable to one another via a pair of spaced apart latching axles such that, after latching of only a first one of the two latching axles, the two quick coupling parts can be pivoted together about said first latching axle and the second latching axle is then latchable, and having an energy circuit coupling, in particular a hydraulic coupling for the automatic coupling of an energy connector at the tool side to an energy connector at the boom side, wherein the energy circuit coupling has an energy coupling part at the boom side and an energy coupling part at the tool side that are arranged spaced apart from the latching axle at the quick coupling part at the boom side or at the quick coupling part at the tool side such that they move together by the pivoting together of the two quick coupling parts about the first latching axle on an orbit about the first latching axle and thereby automatically couple with one another, with at least one of the two energy coupling parts being tiltable about an axle in parallel with the first latching axle and movably supported perpendicular to the first latching axle and a linear guide separate from the energy connector and comprising a pair of guide pins and associated guide bores into which said guide pins travel on the moving together of the two energy coupling parts is associated with the energy circuit coupling and compensates the pivot movement of the two energy coupling parts on the pivoting together on the orbit about the first latching axle in interaction with the movable support and forces the two energy coupling parts to make an exact linear movement relative to one another along a straight line on the coupling, with the quick coupling being characterized in that a centering device is provided by means of which the movably supported energy coupling part is holdable in a central position independently of its alignment and a movement of the movably supported energy part relative to the quick coupling part fastened thereto can be prevented in the absence of an external force, with the centering device being configured to enable a movement of the movably supported energy coupling part relative to the quick coupling part fastened thereto on the automatic coupling with the other energy coupling part due to an external force generated by the coupling procedure.

Provision is made in an embodiment that the centering device comprises at least one centering element that is fixedly or immovably supported at the quick coupling part and holds the movable energy coupling part in the central position in a force transmitting and/or shape matched manner in the absence of an external force. The fixing of the movable energy coupling part by means of the centering element can take place both with shape matching and with force transmission, for example with shape matching in specific directions and with force transmission in other directions.

Provision is made in a further embodiment that the movable energy coupling part is supported at the quick coupling part via a spring device, in particular by an arrangement of one or more compression springs, that presses the movable energy coupling part toward the centering element and thereby holds it in the central position or moves it into the central position again—in particular directly after the removal of an external force deflecting the movable energy coupling part. The spring device generates a pressing force on the centering element that holds the movable energy coupling in the correct position, i.e. the spring device is preloaded in the central position. The spring force or pressing force has to be large enough that the movable energy coupling part is not moved out of the central position in any of the possible installation positions by the weight or strains of possible connector tubes. At the same time, it must be low enough to enable a deflection of the movable energy coupling part on the coupling with the other energy coupling part, on the threading in of the linear guide components, and on the linear leading together. The centered movable energy coupling part therefore has to have a certain movability on the application of an external force going beyond the weight/tube strains, etc.

Provision is made in a further embodiment that the centering device has at least one holding element that is arranged at the movable energy coupling part and that is configured to cooperate with the at least one centering element in a force transmitting and/or shape matching manner. The at least one holding element is therefore movably supported at the quick coupling part together with the movable energy coupling part and is in particular pressed against the at least one centering element by the spring device.

Provision is made in a further embodiment that the holding element comprises a cutout in which the centering element is at least partly received or moved in the central position. The holding element can be the cutout itself or can comprise additional parts.

Provision is made in a further embodiment that the cutout has at least one chamfer and/or rounded portion that cooperates with at least one chamfer and/or rounded portion of the centering element. A certain movability of the movable energy coupling part is ensured by the chamfer/rounded portion of the cooperating elements of the centering device that is required for the coupling procedure.

Provision is made in a further embodiment that the cutout is designed in funnel shape at least along one direction, with the centering element being chamfered and/or rounded at least along just that direction and preferably being configured in pin form. The cutout can therefore be chamfered and/or rounded along at least one direction so that a funnel shape results in a corresponding cross-sectional view. The centering element located partially within the cutout in the central position can thereby move on the application of an external force along the chamfers to enable a movement of the movable energy coupling part on the coupling. A pin-shaped form of the centering element, i.e. a form rounded in the direction of the funnel-shaped embodiment, is advantageous here.

The funnel-shaped design and the preferably pin-shaped rounded portion should be formed at least in a plane that is perpendicular to the axle about which the movable energy coupling part is pivoted on the pivoting procedure. This axle is preferably perpendicular to the straight line along which the linear coming together of the energy coupling parts communicated by the linear guide takes place. The chamfers can furthermore have an angle of 20-70°, in particular of 24-45°.

Provision is made in a further embodiment that the cutout has an in particular continuous recess. The continuous recess is therefore open, i.e. passes through the component of the movable energy coupling part in which the cutout is formed. The recess is preferably smaller than the centering element. This recess has the function of forming an opening within the recess so that no deposits or dirt can accumulate within the cutout that prevents a correct positioning of the centering element. The accumulations move through the recess out of the cutout or are pressed through the centering element into the recess. The recess can, for example, be a bore or a slit and is preferably arranged at the lowest point or at the base of the cutout. Additionally or alternatively to this, the centering element can also have a recess at the side facing the cutout into which dirt accumulating in the cutout can be urged in order not to clog the cutout. It can likewise be continuous.

Provision is made in a further embodiment that the movable energy coupling part is supported at the quick coupling part fastened thereto via two spaced apart carrier elements and is preferably arranged between the carrier elements, with each of the carrier elements having a centering element. The carrier elements can be designed in plate form and can substantially extend perpendicularly starting from the quick coupling part. The movable energy coupling part can be supported at the carrier elements via a spring support. The carrier elements are in particular rigidly connected to the quick coupling part and partially surround the movable energy coupling part.

Provision is made in a further embodiment that the centering elements are configured in pin form and each cooperate with a holding element as previously described. The holding elements are preferably formed at or in a carrier block of the movable energy coupling part that extends substantially between and perpendicular to the carrier elements. The carrier block can have one or more connector pieces that form the energy connector of the movable energy coupling part. In the case of cutouts as holding elements, the cutouts are formed at the upper side of the carrier block remote from the quick coupling part, in particular at the edges or sides that are adjacent to the carrier elements. Such a design can be implemented particularly simply since the cutouts forming the holding elements are only laterally introduced at the upper side of the carrier block—for example by milling and/or drilling—and the pin-shaped centering elements have to be attached—for example screwed—to the inner surfaces of the carrier elements at the corresponding points or at the corresponding distance from the quick coupling part.

Provision is made in a further embodiment that the pin-shaped centering elements are conical and are fastened to the carrier elements via the narrower ends. The chamfer/rounded portion of the conical shape of the centering elements enables a displacement out of the cutouts of deposits or dirt that has possibly accumulated in the cutouts so that a correct positioning of the centering elements in the cutouts is possible. The cutouts are preferably open toward the sides of the carrier block so that dirt/deposits can be urged out of the cutouts by the conical form of the centering elements.

Provision is made in a further embodiment that at least four centering elements and at least four holding elements are provided, with each of the carrier elements having at least two centering elements each. Of the at least two centering elements provided at each side, one is preferably connected to the carrier element via a fixed support and the other via a loose support and thus form a fixed/loose arrangement, i.e. the centering element connected via the loose support is not rigidly connected to the carrier element, but rather movably supported so that a certain relative movability is present between the two centering elements. More than one centering element per carrier element can thereby be used, which increases the stability of the centering and nevertheless ensures the required degree of movability of the movable energy coupling part for the coupling procedure. It is furthermore conceivable to rotatably support one or more of the centering elements at the carrier element.

Provision is made in a further embodiment that the energy connector of the movable energy coupling part is arranged on the side of the carrier block remote from the movable support at the quick coupling part and is configured such that, on the coupling with the other energy coupling part, a coupling with the other energy connector arranged thereat is automatically established to establish an energy circuit connection. The energy connector can comprise one or more connector pieces that can be pushed together or that can be connected with corresponding connector pieces of the other energy coupling part and effect the corresponding energy connection (e.g. a hydraulic fluid connection). The connector pieces in particular extend perpendicularly away from the carrier block and can be connector pieces of female and male types known per se. The carrier block can in this sense also be called a connector block.

Provision is made in a further embodiment that the movable energy coupling part is arranged at the quick coupling part of a tool, in particular of a wheel loader blade, at the tool side and is preferably aligned such that the coupling of the energy coupling part communicated by the linear guide takes place along a substantially horizontal line. The movable energy coupling part is therefore rotated by approximately 90° to the typical installation position used at the hydraulic excavator. Without the centering device in accordance with the invention, the movable energy coupling part would be tilted out of the central position required for the frictionless coupling procedure by the weight, by the tube strains, and by the movable support.

The linear guide preferably comprises at least two guide pins at an energy coupling part and associated guide bores at the other energy coupling part into which said guide pins travel on the moving together of the two energy coupling parts. In this process, they force the spring device to make a deflection to compensate the pivot movement component. The guide pins are rigidly connected to the carrier block and project perpendicularly over it toward the oppositely disposed energy coupling part. Each guide pin is preferably substantially cylindrical and has a rounded head that prevents a canting on the introduction into the guide pins. Provision can furthermore be made that the holding elements/cutouts in the carrier block are arranged in alignment or in a line with the guide pins/guide bores of the linear guide.

The present invention further relates to a working machine, in particular to a wheel loader, having a quick coupling in accordance with the invention. In this respect, the same advantages and properties obviously result for the quick coupling in accordance with the invention so that a repeat description will be dispensed with at this point. The above statements with respect to the possible embodiments of the quick coupling in accordance with the invention therefore apply accordingly.

BRIEF DESCRIPTION OF FIGURES

Further features, details, and advantages of the invention result from the embodiments explained in the following with reference to the Figures. There are shown.

DETAILED DESCRIPTION

Figure 1:
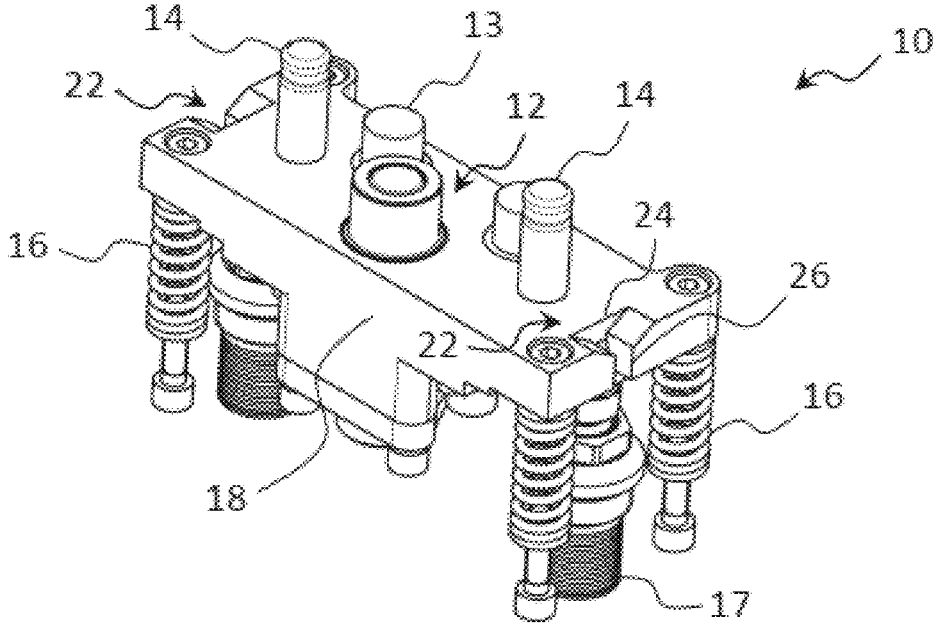
FIG. 1: an embodiment of the movable energy coupling part of the quick coupling in accordance with the invention in a perspective view.

The preferred embodiment of the quick coupling in accordance with the invention discussed in the following is substantially a quick coupling in accordance with EP 1 239 087 A1, with a centering device additionally being provided that will be described in detail in the following. Those elements and properties of the quick coupling in accordance with the invention that are not explicitly described in the following preferably correspond to one of the embodiments disclosed in EP 1 239 087 A1.

The quick coupling in accordance with the invention comprises a quick coupling part at the boom side and at the tool side that are reversibly latchable to one another via a pair of spaced apart parallel latching acles. The quick coupling has an energy circuit coupling comprising an energy coupling part at the tool side fastened to the quick coupling part at the tool side and an energy coupling part at the boom side fastened to the quick coupling part at the boom side. The energy coupling part at the tool side is movably supported at the quick coupling part via a spring device 16 and will be called a movable energy coupling part 10 in the following. The other energy coupling part fastened to the quick coupling part at the boom side is not movably supported in this embodiment, which is, however, not compulsory. The other energy coupling part could therefore likewise be movably supported in an embodiment.

The energy coupling parts each have an energy connector 12 that comprises a plurality of connector pieces 13 that are each arranged at a carrier block 18 and project perpendicularly therefrom. An energy circuit connection, in particular a hydraulic connection to supply a hydraulic tool with hydraulic oil, is closed by connecting or coupling the energy connectors 12 or the respective connector pieces 13. It can in this respect, for example, be a wheel loader blade having hydraulic components.

The energy coupling parts furthermore have a linear guide 14 that forces the energy coupling parts to make a relative movement toward one another along a line or a straight line against the orbital pivot movement about one of the two latching axles. In the present embodiment, the linear guide comprises two parallel guide pins 14 that are arranged at the carrier block 18 of the movable energy coupling part 10 and project perpendicularly therefrom and corresponding guide bores at the other energy guide part into which the guide pins 14 travel on the coupling and force the linear coupling movement before the connector pieces 13 move into engagement with one another.

Reference is explicitly made to EP 1 239 087 A1 with respect to further details, properties, and advantages of the quick coupling parts, energy coupling parts, and linear guide and to the further design of the quick coupling. In the following, only the movable energy coupling part 10 and its support at the quick coupling part and the centering device in accordance with the invention will be discussed.

In FIG. 1, the movable energy coupling part 10 of the quick coupling in accordance with the invention is shown in a perspective view, with the quick coupling part fastened thereto being removed for reasons of clarity. The movable energy coupling part 10 comprises a substantially plate-shaped carrier block 18 that is movably supported at the quick coupling part on a spring device 16 comprising four compression springs. A plurality of connector pieces 13 and two guide pins 14 of the linear guide are arranged at the carrier block 18 and project in parallel from the surface of the carrier block 18 disposed opposite the spring device 16. Two pressure rams 17 are furthermore arranged at the side of the spring device 16 whose function is described in EP 1 239 087 A1.

Figure 2:
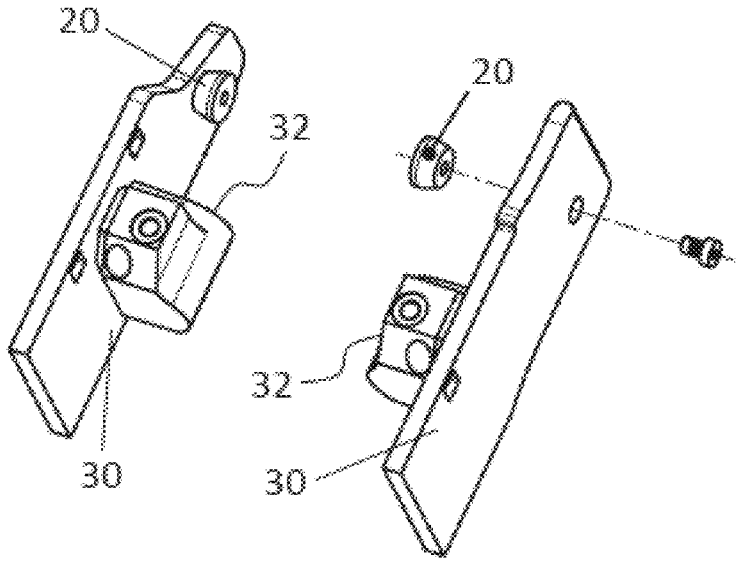
FIG. 2: two carrier elements for fastening the energy coupling part in accordance with FIG. 1 to a quick coupling part in a perspective view.

The movable energy coupling part 10 is supported at two lateral carrier elements 30 that are rigidly connected to the quick coupling part. The carrier elements 30 are shown individually in a perspective view in FIG. 2. They are designed in plate form, differ in shape from one another, and are aligned in parallel with one another. The carrier elements 30 are arranged spaced apart from one another so that the carrier block 18 is supported between them that is installed via the spring device 16 at two fasteners 32 that are formed or installed at the inner sides of the carrier elements 30. The pressure rams 17 are installed at the fasteners 32.

The carrier block 18 and the positions of the components arranged thereat are axially symmetrical. It has a substantially rectangular basic shape in a plan view and extends substantially perpendicular between the carrier elements 30. The short sides of the carrier block 18 lie at the carrier elements 30.

In accordance with the invention, a centering element 20 is installed at the inner side of each carrier element 30, in the present embodiment via a screw connection. The carrier block 18 furthermore has two cutouts 24 laterally in the region of the edges, said cutouts 24 forming the holding elements 22 that cooperate with the centering elements 20 and form the centering device in accordance with the invention with them. The centering elements 20 are rigidly connected to the quick coupling part via the carrier elements 30 while the holding elements 22 are movably supported and are movable relative to the centering elements 20 due to the sprung support of the carrier block 18.

Figure 3:
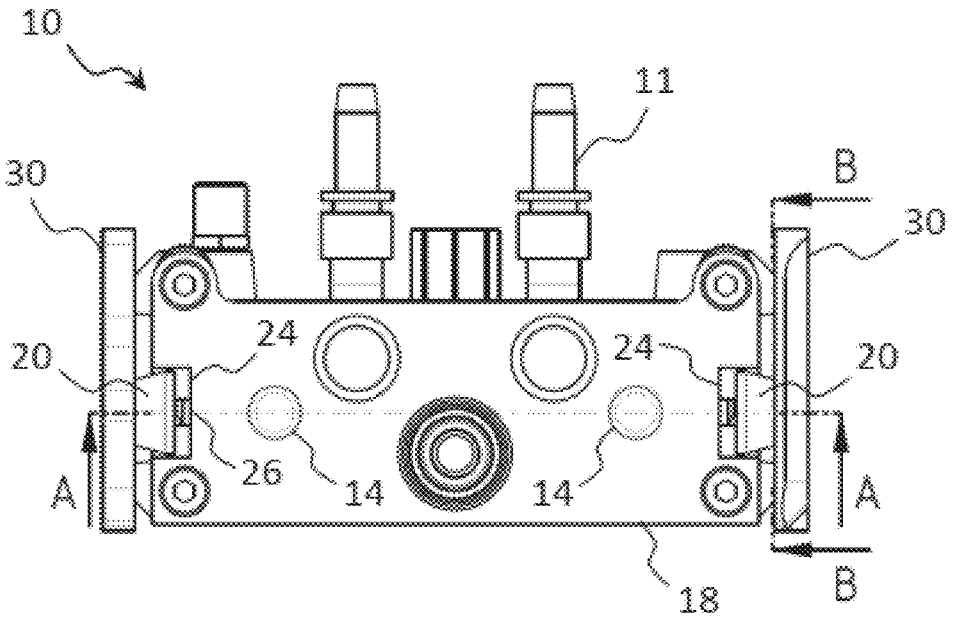
FIG. 3: the energy coupling part in accordance with FIG. 1 fastened to the carrier elements in accordance with FIG. 2 in a plan view.
Figure 4:
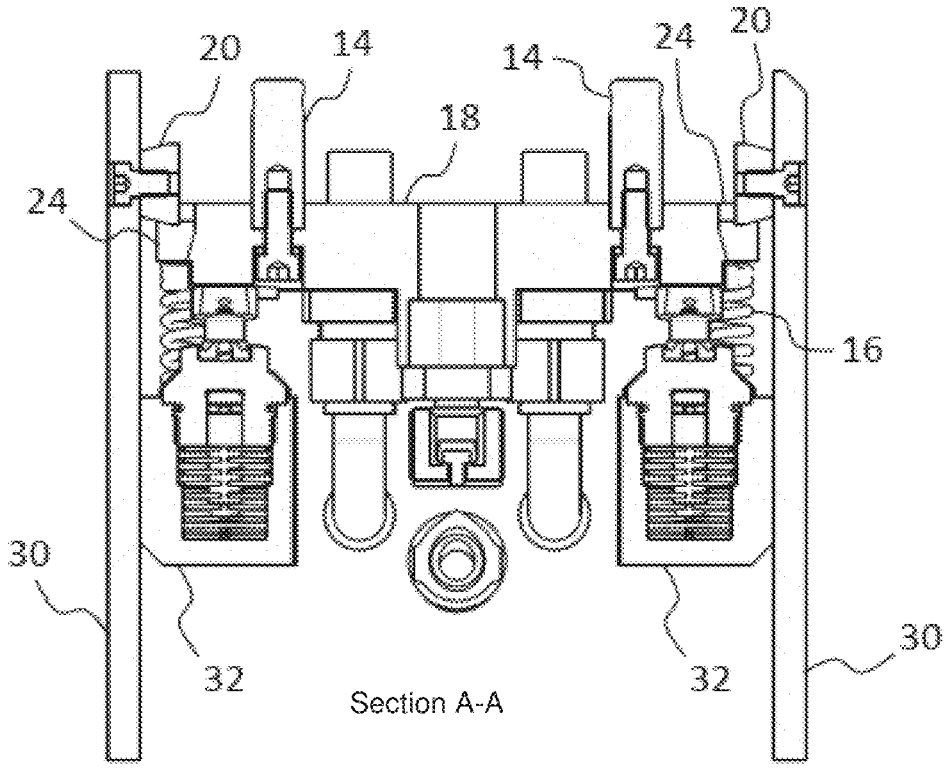
FIG. 4: a frontal cross-sectional view of the device in accordance with FIG. 3 along the line AA.

FIG. 3 shows the movable energy coupling part 10 together with the carrier elements 30 at which it is installed in a plan view. A frontal cross-sectional view along the line AA is shown in FIG. 4 and a lateral cross-sectional view along the line BB in FIG. 5.

The centering elements 20 are fastened to the carrier elements 30 at such a distance from the fasteners 32 that the carrier block 18 is urged against the centering elements 20 by the spring device 16. The carrier block 18 or the movable energy coupling part 10 are held in a defined position, that is called the central position in the present case, by this pressing force. In this central position, a correct and cant-free threading of the guide pints 14 into the corresponding guide bores of the other energy coupling part (not shown) can take place in the coupling procedure. The movable energy coupling part 10 is also held in the central position by the pressing when the carrier block 18 is not substantially horizontally oriented (as is the case, for example, in EP 1 239 087 A1), but rather has a different, in particular vertical, installation position. The pressing force here is dimensioned such that the movable energy coupling part 10 is not moved out of the central position in any installation position due to the weight and/or the stiffness/strain of the tubes (not shown) connected thereto via the tube connector 11. The quick coupling in accordance with the invention is thereby in particular suitable for use at a wheel loader blade.

To ensure a certain movability of the carrier block 18 that is required for the compensation of the circular movement on the coupling procedure by means of the linear guide 14 despite the pressing force generated by the spring device 16, the cutouts 24 are funnel-shaped and the centering elements 20 are round pins. The cutouts 24 have a rectangular shape or slit shape in the plan view and are conically chamfered along the short sides of the carrier block 18 toward the center. The chamfers have an angle of approximately 30°, with different angles also being possible. In the center of each cutout 24, the chamfers merge into a rectangular recess 25 that passes through the total carrier block 18 and that opens into the lower side of the carrier block 18. The cutouts 24 are furthermore open laterally at the short sides of the carrier block 18, i.e. open toward the carrier elements 30.

The centering elements 20 are configured as conically shaped pins having a circular cross-section and are fastened to the carrier elements 30 via the short side. In the central position, the centering elements 20 are partially received in the cutouts 24 (cf. FIG. 4 and FIG. 5). Due to the chamfers, a movement of the carrier block 18, in particular a pivoting or tilting about a pivot axis in parallel with the first latching axle and/or a displacement relative to the centering elements 20, is possible by external forces arising in the coupling procedure. The carrier block 18 or the movable energy coupling part 10 is thus held in the central position by the centering elements 20 in a shape matched form in the direction of the coupling straight lines defined by the linear guide 14 and in force transmitting form in a direction perpendicular thereto.

The pressing force by the spring device 16 is set such that the movability of the carrier block 18 is ensured on the occurrence of an external force generated as a result of the coupling procedure. If the carrier block 18 is deflected from the central position by such an external force and if this external force is removed, the movable energy coupling part 10 is again moved back or pressed back into the central position by the spring device 16.

Figure 5:
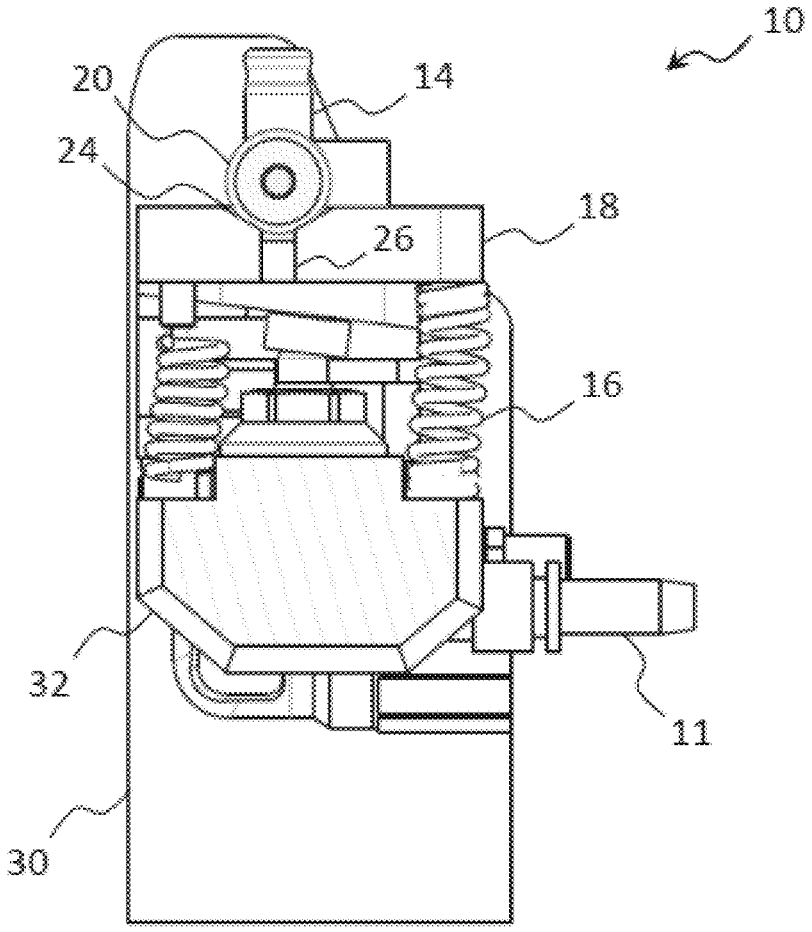
FIG. 5: a lateral cross-sectional view of the device in accordance with FIG. 3 along the line BB.

As can be seen in FIG. 5, the compression springs of the spring device 16 are not compressed uniformly in the central position and are not aligned in parallel with one another. The centering elements 20 are furthermore not arranged centrally above the carrier block 18, but rather slightly laterally offset therefrom, and indeed on the straight line connecting the guide pins 14. However, other arrangements of the centering elements 20 are also possible, for example an arrangement in which they are not aligned with the guide pins 14.

The recesses 26 in the cutouts 24 prevent dirt or deposits from being able to accumulate in the cutouts 24 and to block them, which would prevent a correct positioning of the movable energy coupling part 10. The deposits are pressed through the centering elements 20 into the cutouts 26 and are thereby urged out of the cutouts 24. The conical shape of the centering elements 20 furthermore also provide that dirt or deposits are laterally urged outwardly out of the cutouts 24. The cutouts 24 thereby always remain free of contaminants, which ensures a correct positioning in the central position.

Figure 6:
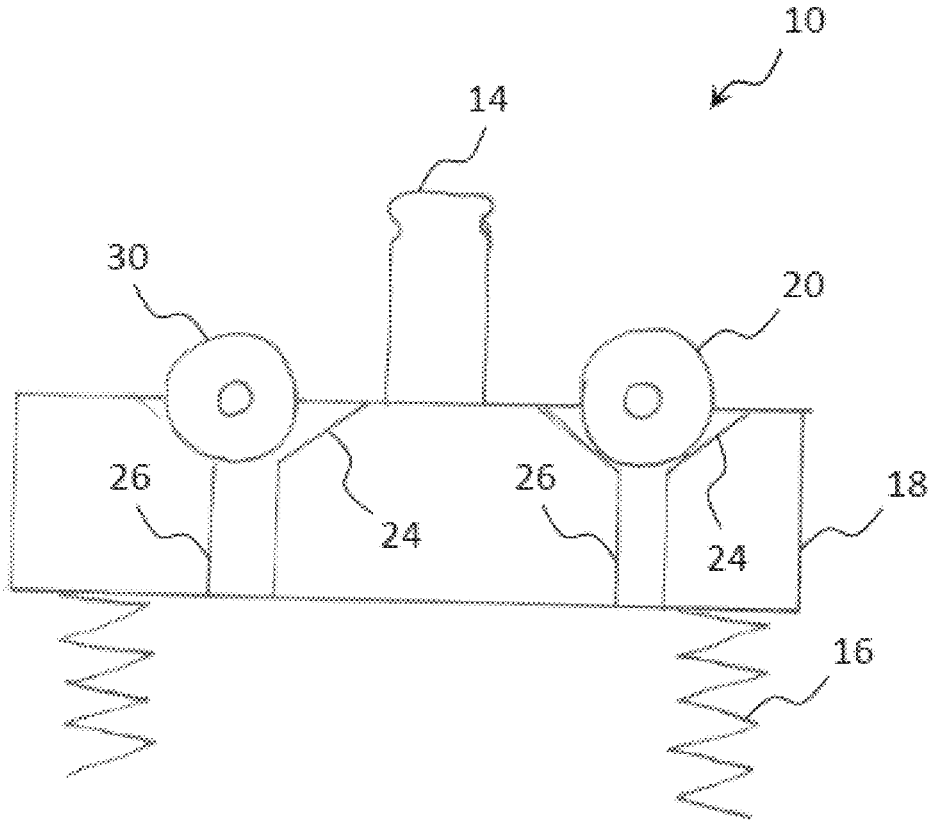
FIG. 6: an alternative embodiment of the movable energy coupling part of the quick coupling in accordance with the invention in a schematic side view.

FIG. 6 shows a further embodiment of the movable energy coupling part 10 of the quick coupling in accordance with the invention in a side view with a view toward the short side of the carrier block 18. Two centering elements 20 are provided here instead of one centering element 20 per carrier element. The carrier block 18 correspondingly has two funnel-shaped cutouts 24 at each short side. The two centering elements 20 of each carrier element 30 form a fixed-loose arrangement, with one of the centering elements 20 being connected to the quick coupling part or to the carrier element 30 via a fixed support and the other via a loose support. It is thereby possible to provide more than one centering element 20 per carrier element 30, which increases the inherent stability of the movable energy coupling part 10 in the central position, but nevertheless permits a certain movability of the carrier block 18 for the purpose of the coupling with the other energy coupling part. A use of more than two centering elements 20 per side/carrier element 30 is also conceivable here. A rotatable support of one or more centering elements 20 at the carrier elements 30 could also be provided.

REFERENCE NUMERAL LIST

10 movable energy coupling part
11 tube connector
12 energy connector
13 connector piece
14 linear guide/guide pin
16 spring device
17 pressure ram
18 carrier block
20 centering element
22 holding element
24 cutout
26 recess
30 carrier piece
32 fastener

The invention claimed is:

1. A quick coupling for coupling a tool to a boom of a working machine, comprising:

a quick coupling part at a boom side and a quick coupling part at a tool side; and an energy circuit coupling for an automatic coupling of an energy connector at the tool side to an energy connector at the boom side, wherein the quick coupling parts are reversibly latchable to one another via a pair of spaced apart latching axles;

wherein the energy circuit coupling comprises an energy coupling part at the boom side and at the tool side that are arranged at the quick coupling parts such that they move toward one another and thereby automatically couple with one another by pivoting together of the quick coupling parts about a first latching axle on an orbit about the first latching axle;

wherein at least one movable energy coupling part is pivotable about an axle in parallel with the first latching axle and is movably supported perpendicular thereto;

wherein the energy circuit coupling comprises a linear guide that is configured to compensate relative movement of the energy coupling parts occurring along an orbit on the pivoting together of the quick coupling parts in cooperation with a movable support of the energy coupling parts and to guide the energy coupling parts linearly with respect to one another during coupling, comprising a centering device by means of which the movable energy coupling part is holdable in a central position independently of its alignment and a movement of the movable energy coupling part relative to the quick coupling part fastened thereto is preventable in the absence of an external force, with the centering device being configured to enable the movement of the movable energy coupling part relative to the quick coupling part fastened thereto on the automatic coupling with the other energy coupling part due to an external force generated by a coupling procedure;

wherein the centering device comprises at least one centering element that is fixedly supported at the quick coupling part and holds the movable energy coupling part in the central position in a force transmitting and/or shape matched manner in the absence of an external force; and wherein the centering device has at least one holding element that is arranged at the movable energy coupling part and that is configured to cooperate with the at least one centering element in a force transmitting and/or shape matching manner.

2. The quick coupling in accordance with claim 1, wherein the energy coupling part is supported at the quick coupling part via a spring device, that presses the movable energy coupling part against the centering element.

3. The quick coupling in accordance with claim 1, wherein the holding element comprises a cutout in which the centering element is at least partially received in the central position.

4. The quick coupling in accordance with claim 3, wherein the cutout has at least one chamfer and/or rounded portion that cooperates with at least one chamfer and/or rounded portion of the centering element.

5. The quick coupling in accordance with claim 4, wherein the cutout is designed in funnel shape at least along one direction, with the centering element being chamfered and/or rounded at least along just that direction.

6. The quick coupling in accordance with claim 3, wherein the cutout has a continuous recess.

7. The quick coupling in accordance with claim 1, wherein the movable energy coupling part is supported at the quick coupling part fastened thereto via two spaced apart carrier elements.

8. A quick coupling for coupling a tool to a boom of a working machine, comprising:

a quick coupling part at a boom side and a quick coupling part at a tool side; and an energy circuit coupling for an automatic coupling of an energy connector at the tool side to an energy connector at the boom side, wherein the quick coupling parts are reversibly latchable to one another via a pair of spaced apart latching axles;

wherein the energy circuit coupling comprises an energy coupling part at the boom side and at the tool side that are arranged at the quick coupling parts such that they move toward one another and thereby automatically couple with one another by pivoting together of the quick coupling parts about a first latching axle on an orbit about the first latching axle;

wherein at least one movable energy coupling part is pivotable about an axle in parallel with the first latching axle and is movably supported perpendicular thereto;

wherein the energy circuit coupling comprises a linear guide that is configured to compensate relative movement of the energy coupling parts occurring along an orbit on the pivoting together of the quick coupling parts in cooperation with a movable support of the energy coupling parts and to guide the energy coupling parts linearly with respect to one another during coupling, comprising a centering device by means of which the movable energy coupling part is holdable in a central position independently of its alignment and a movement of the movable energy coupling part relative to the quick coupling part fastened thereto is preventable in the absence of an external force, with the centering device being configured to enable the movement of the movable energy coupling part relative to the quick coupling part fastened thereto on the automatic coupling with the other energy coupling part due to an external force generated by a coupling procedure;

wherein the movable energy coupling part is supported at the quick coupling part fastened thereto via two spaced apart carrier elements; and wherein the centering element is configured in pin form and cooperates with a holding element, with the holding element being formed at or in a carrier block of the coupling part that substantially extends between the carrier elements and perpendicular thereto.

9. The quick coupling in accordance with claim 8, wherein the centering element is conical and is fastened to the carrier elements via narrower ends.

10. The quick coupling in accordance with claim 8, wherein at least four centering elements and at least four holding elements are provided, with each of the carrier elements having at least two respective centering elements of which one is connected to one of the carrier elements via a fixed support and the other via a loose support such that two respective centering elements form a fixed-loose arrangement.

11. The quick coupling in accordance with claim 10, wherein the energy connector of the movable energy coupling part is arranged on the side of the carrier block remote from the movable support at the quick coupling part and is configured such that, on the coupling with the other energy coupling part, a coupling with the other energy connector arranged thereat is automatically established to establish an energy circuit connection.

12. The quick coupling in accordance with claim 1, wherein the movable energy coupling part is arranged at the quick coupling part of a tool, and is aligned such that the coupling of the energy coupling part communicated by the linear guide takes place along a substantially horizontal line.

13. A working machine, in particular a wheel loader, having a quick coupling part in accordance with claim 1.

14. The quick coupling in accordance with claim 5, wherein the centering element is configured in pin form.

15. A quick coupling for coupling a tool to a boom of a working machine, comprising:

a quick coupling part at a boom side and a quick coupling part at a tool side; and an energy circuit coupling for an automatic coupling of an energy connector at the tool side to an energy connector at the boom side, wherein the quick coupling parts are reversibly latchable to one another via a pair of spaced apart latching axles;

wherein the energy circuit coupling comprises an energy coupling part at the boom side and at the tool side that are arranged at the quick coupling parts such that they move toward one another and thereby automatically couple with one another by pivoting together of the quick coupling parts about a first latching axle on an orbit about the first latching axle;

wherein at least one movable energy coupling part is pivotable about an axle in parallel with the first latching axle and is movably supported perpendicular thereto;

wherein the energy circuit coupling comprises a linear guide that is configured to compensate relative movement of the energy coupling parts occurring along an orbit on the pivoting together of the quick coupling parts in cooperation with a movable support of the energy coupling parts and to guide the energy coupling parts linearly with respect to one another during coupling, comprising a centering device by means of which the movable energy coupling part is holdable in a central position independently of its alignment and a movement of the movable energy coupling part relative to the quick coupling part fastened thereto is preventable in the absence of an external force, with the centering device being configured to enable the movement of the movable energy coupling part relative to the quick coupling part fastened thereto on the automatic coupling with the other energy coupling part due to an external force generated by a coupling procedure;

wherein the movable energy coupling part is supported at the quick coupling part fastened thereto via two spaced apart carrier elements; and wherein the two spaced apart carrier elements are arranged between the carrier elements, with each of the carrier elements having a centering element.

* * * * *